US007503639B2

(12) United States Patent
Ohmori et al.

(10) Patent No.: US 7,503,639 B2
(45) Date of Patent: Mar. 17, 2009

(54) INK-JET PRINTER

(75) Inventors: Hisao Ohmori, Hamamatsu (JP); Yuji Sakata, Hamamatsu (JP)

(73) Assignee: Roland DG Corporation, Hamamatsu (JP)

( * ) Notice: Subject to any disclaimer, the term of this patent is extended or adjusted under 35 U.S.C. 154(b) by 513 days.

(21) Appl. No.: 11/400,318

(22) Filed: Apr. 10, 2006

(65) Prior Publication Data

US 2007/0126786 A1 Jun. 7, 2007

(30) Foreign Application Priority Data

Dec. 1, 2005 (JP) ..... 2005-347527

(51) Int. Cl.
*B41J 23/00* (2006.01)
*B41J 2/01* (2006.01)

(52) U.S. Cl. ..... 347/37; 347/101

(58) Field of Classification Search ..... 347/37, 347/101

See application file for complete search history.

(56) References Cited

U.S. PATENT DOCUMENTS 5,363,132 A * 11/1994 Ikkatai ..... 347/8
2005/0141945 A1 6/2005 Lai

FOREIGN PATENT DOCUMENTS

EP 0 512 184 A1 11/1992
GB 2 295 584 A 6/1996
JP 11138848 A * 5/1999 ..... 347/37

* cited by examiner

*Primary Examiner*—Julian D Huffman
*Assistant Examiner*—Jason S Uhlenhake
(74) *Attorney, Agent, or Firm*—Birch, Stewart, Kolasch & Birch, LLP

(57) ABSTRACT

In order to simplify a constitution of a locking member capable of locking engageably and detachably an ink head with a stationary region, an ink-jet printer comprises a first carriage supported relatively transferable in a predetermined direction with respect to the medium; a second carriage supported relatively transferable in the predetermined direction with respect to the medium and juxtaposed so as to position on a side in the predetermined direction of the first carriage; a slide means disposed on the first carriage to be transferable in a direction intersecting with the predetermined direction; an ink head disposed fixedly on the slide means and capable of discharging an ink on the medium; a cutting head disposed fixedly on the second carriage and capable of cutting out the medium; a locking member transferred with transfer of the first carriage towards the predetermined direction and transfer of the slide means towards direction intersecting with the predetermined direction to lock engageably and detachably with a stationary region; and a coupling means for coupling separably the first carriage to the second carriage.

10 Claims, 6 Drawing Sheets

INK-JET PRINTER

BACKGROUND OF THE INVENTION

1. Field of the Invention

The present invention relates to an ink-jet printer, and more particularly to an ink-jet printer used suitably in case of printing on a medium such as a recording paper, for example, conducting color printing at a high speed and in a high resolution by means of numerical control.

In the present specification, the term "medium" means a variety of recording media comprising papers such as plain paper, as a matter of course, and further includes also a variety of materials such as a resin material of PVC, polyester or the like, and other materials such as aluminum, iron, and wood.

Furthermore, the term "ink jet printing" in the present specification means printing methods realized by ink-jet technology according to various manners which have heretofore been well-known including various types of continuous method such as a binary deflection method, and a continuous deflection method; or a variety of drop-on-demand ink-jet methods such as a thermal ink-jet method, and a piezoelectric ink-jet method.

2. Description of the Related Art

Heretofore, an ink-jet printer the whole operations of which are controlled by a microcomputer, in which an ink head travelling on a medium, for example, a recording paper fed from a sheet feeder in a breadth direction of the recording paper (hereinafter referred optionally to as "main scanning direction" in the present specification) is used, whereby a predetermined printing is made on the recording paper according to an ink-jet method is well known.

Furthermore, such a device which is obtained by adding a function for cutting a picture image or the like printed on a recording paper to another function of image-formation for producing a picture image on a recording paper through a printing operation in the above-described ink-jet printer has also been proposed.

Such ink-jet printer including an image-forming function and a cutting function is provided with an ink head which is a component for realizing an image-forming function of image-formation by printing an image on a recording paper based on image data, and a cutter which is a component for realizing a cutting function by cutting the recording paper based on the image data.

In the above-described ink-jet printer provided with an ink head and a cutting head, generally, the ink head is coupled separably to the cutting head by means of a coupling means, and further the ink head may be engaged with a stationary region of the ink-jet printer by means of an engaging means in an engageable and detachable manner.

In the case when an image is formed on a recording paper based on image data by means of the ink head, the engaging means causes the ink head to disengage from the stationary region, and at the same time, the coupling means couples the ink head with the cutting head, so that the ink head is transferred associatedly with the cutting head.

On one hand, when a recording paper is cut out based on image data by means of the cutting head, the engaging means causes the ink head to engage with the stationary region, and at the same time, the coupling means decouples the ink head from the cutting head, whereby only the cutting head is transferred.

In these circumstances, since an engaging means which makes an ink head engageable with a stationary region of a conventional ink-jet printer provided with the ink head and a cutting head in an engageable and detachable manner is constituted in such that the ink head engages or disengages automatically with the stationary region due to a relative movement among three components of the ink head, the cutting head, and the stationary region, there is such a problem that the constitution of the ink-jet printer becomes complicated, and assembling operations therefor become also complicated.

OBJECT AND SUMMARY OF THE INVENTION

The present invention has been made in view of the above-described various problems involved in the prior art, and an object of the invention is to provide an ink-jet printer including an engaging means which makes an ink head engageable with a stationary region of the ink-jet printer in an engageable and detachable manner wherein the engaging means is realized by a simple structure.

In order to achieve the above-described object, an ink-jet printer capable of discharging an ink on a medium and cutting out the medium according to the present invention may comprise a first carriage supported relatively transferable in a predetermined direction with respect to the medium; a second carriage supported relatively transferable in the predetermined direction with respect to the medium and juxtaposed so as to position on a side in the predetermined direction of the first carriage; a slide means disposed on the first carriage to be transferable in a direction intersecting with the predetermined direction; an ink head disposed fixedly on the slide means and capable of discharging an ink on the medium; a cutting head disposed fixedly on the second carriage and capable of cutting out the medium; a locking member transferred with transfer of the first carriage towards the predetermined direction and transfer of the slide means towards direction intersecting with the predetermined direction to lock engageably and detachably with a stationary region; and a coupling means for coupling separably the first carriage to the second carriage.

Furthermore, an ink-jet printer capable of discharging an ink on a medium and cutting out the medium according to the present invention may comprise a first carriage supported relatively transferable in a predetermined direction with respect to the medium; a second carriage supported relatively transferable in the predetermined direction with respect to the medium and juxtaposed so as to position on a side in the predetermined direction of the first carriage; a slide means disposed on the first carriage to be transferable in a direction intersecting with the predetermined direction; an ink head disposed fixedly on the slide means and capable of discharging an ink on the medium; a cutting head disposed fixedly on the second carriage and capable of cutting out the medium; a locking member transferred with transfer of the first carriage towards the predetermined direction and transfer of the slide means towards direction intersecting with the predetermined direction to lock engageably and detachably with a stationary region; and a coupling means for coupling separably the first carriage to the second carriage; the locking member being allowed to disengage from the stationary region, whereby the first carriage is detached from the stationary region and the first carriage is coupled to the second carriage by the coupling means, so that the ink head disposed on the first carriage is transferred associatedly with the cutting head disposed on the second carriage in case of printing on the medium; while the locking member being allowed to engage with the stationary region, whereby the first carriage is engaged with the stationary region and the first carriage is separated from the second carriage by the coupling means, so that only the cutting head disposed on the second carriage is transferred in case of cutting the medium.

In the invention, the slide means may be provided with a guide rail disposed on a wall surface of the first carriage and extended in a direction intersecting with the predetermined direction; and a slide block disposed transferably along the guide rail.

In the invention, the ink head may be disposed fixedly to the slide block.

The ink-jet printer of the invention may comprise further a driving means for driving the slide block.

In the invention, the direction intersecting with the predetermined direction may be a direction intersecting with the predetermined direction at right angles.

In the invention, the locking means may be formed extensively in a direction of the stationary region and may have a bent extreme end; and the stationary region may have a hole for engaging with the extreme end of the locking member.

In the invention, the coupling means may be composed of magnets.

In the invention, an attraction force of the magnets may be smaller than an engagement force derived from an engagement of the locking member and the stationary region.

Thus, the present invention provides such an excellent advantageous effect to make an ink head engageable with a stationary region of an ink-jet printer in an engageable and detachable manner by a simple structure.

As a result, printing can be made on a desired medium, and further, a picture image printed can be cut out according to the present invention, so that it may be applied to a preparation of a variety of posters, and a production of displays for advertisement.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

In the following, an example of manner of practice of an ink-jet printer according to the present invention will be described in detail by referring to the accompanying drawings.

Figure 1:
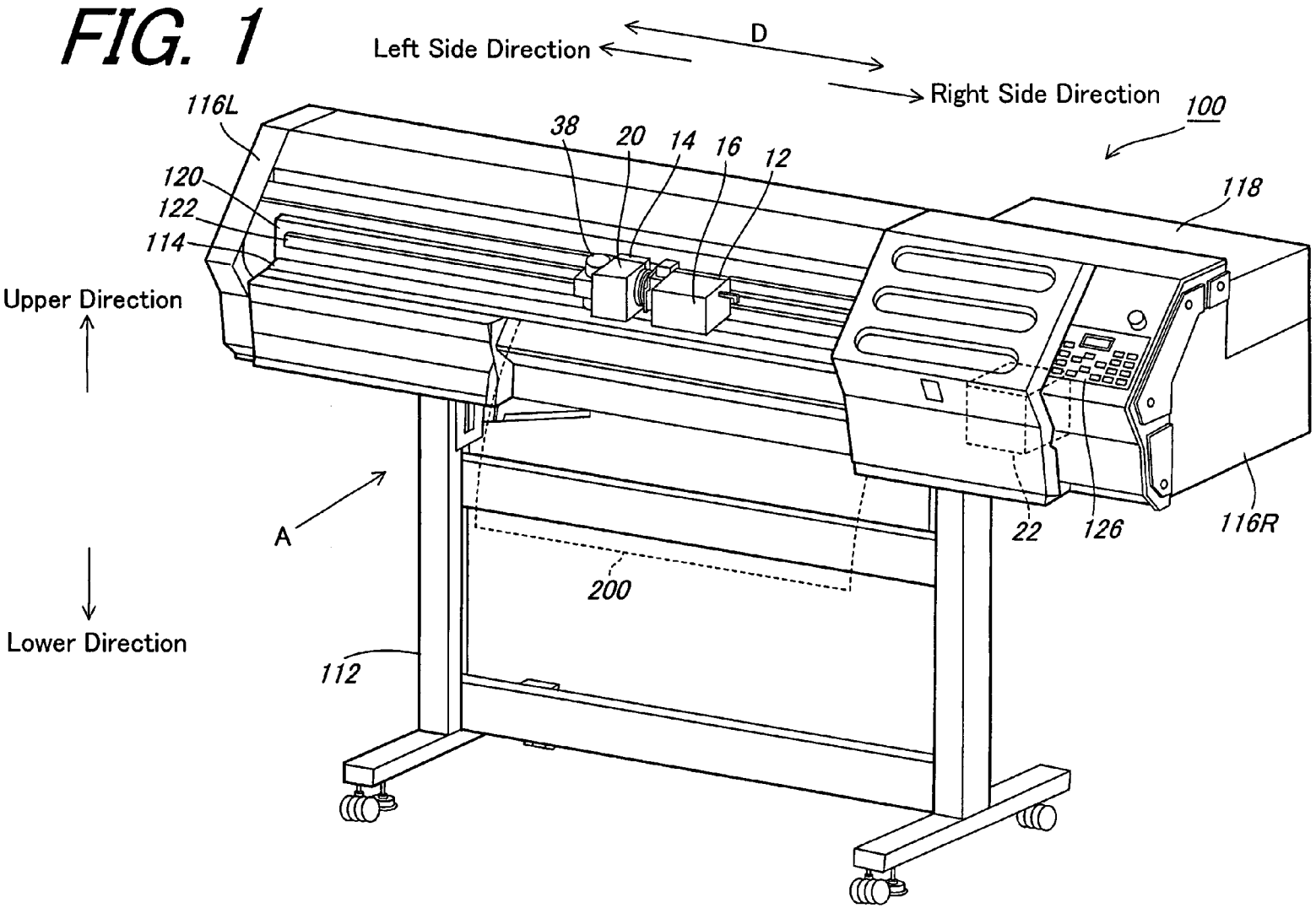
FIG. 1 is a schematic constitutional explanatory view showing an ink-jet printer according to an example in a manner of practice of the present invention.
Figure 2:
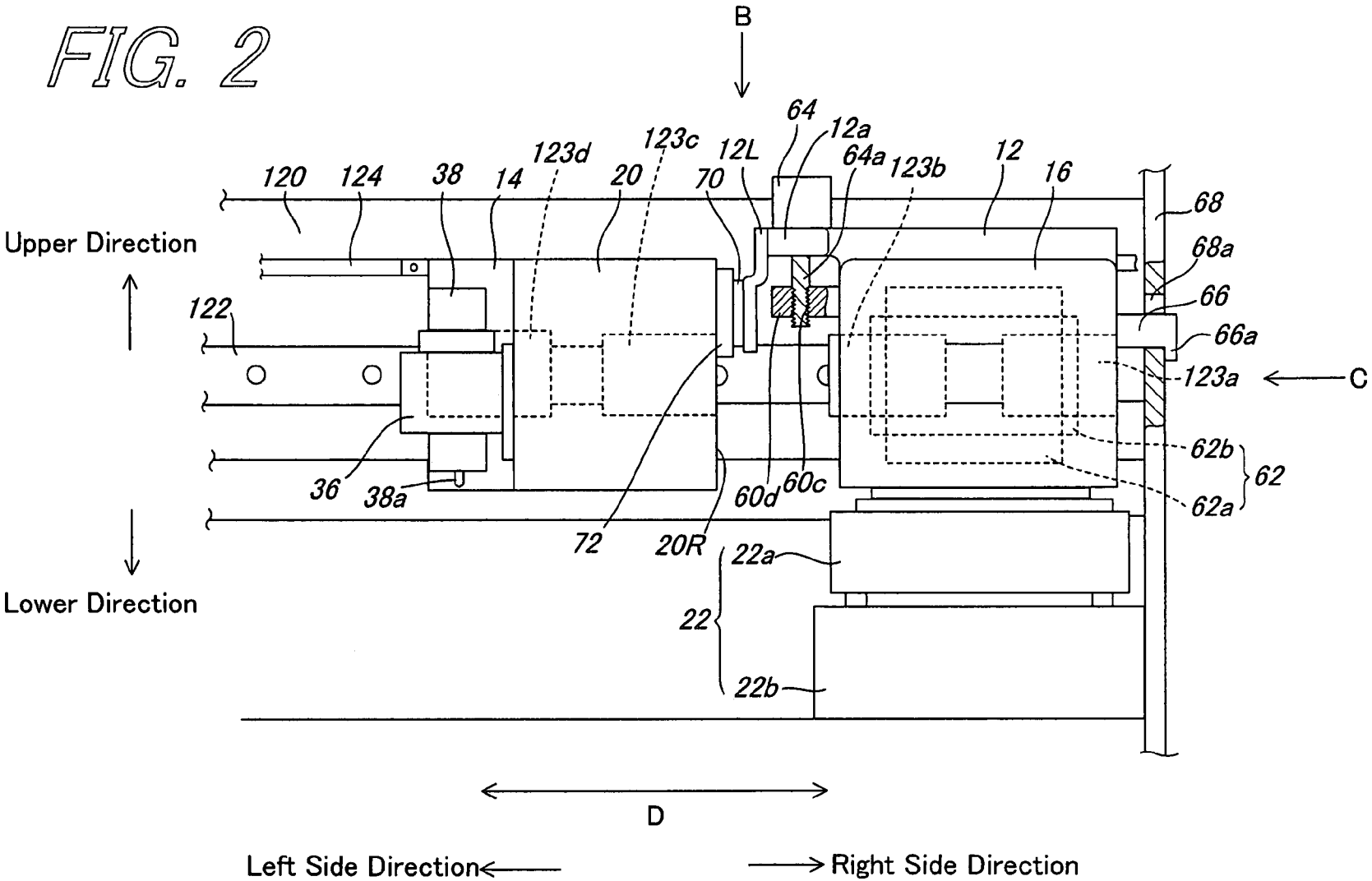
FIG. 2 is an explanatory view showing schematically an essential part of FIG. 1 wherein it is the explanatory view showing the essential part of FIG. 1 partially cutaway in the direction of the arrow A in FIG. 1.
Figure 3:
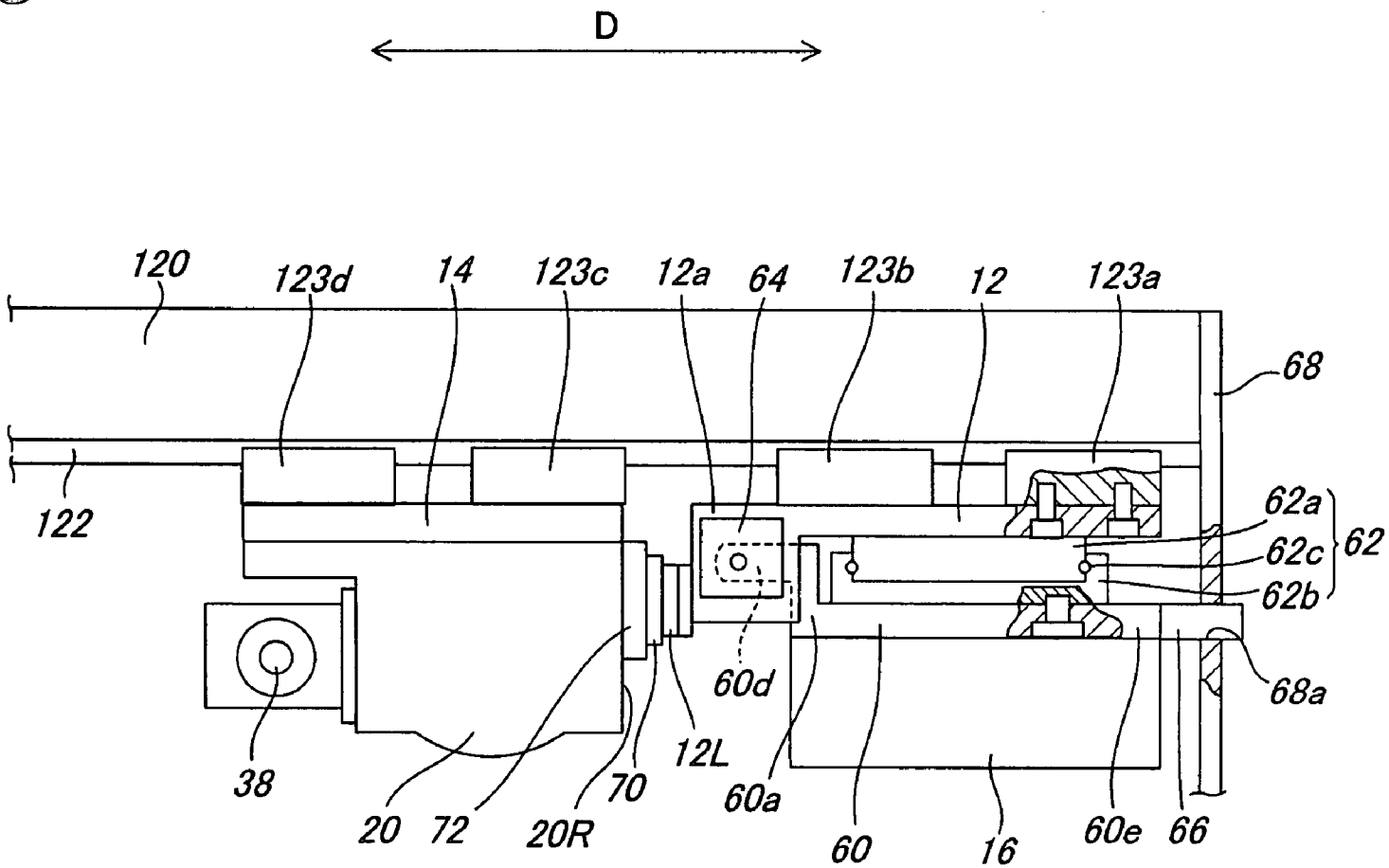
FIG. 3 is an explanatory view showing schematically the essential part of FIG. 1 wherein it is the explanatory view showing the essential part of FIG. 2 partially cutaway in the direction of the arrow B in FIG. 2.
Figure 4:
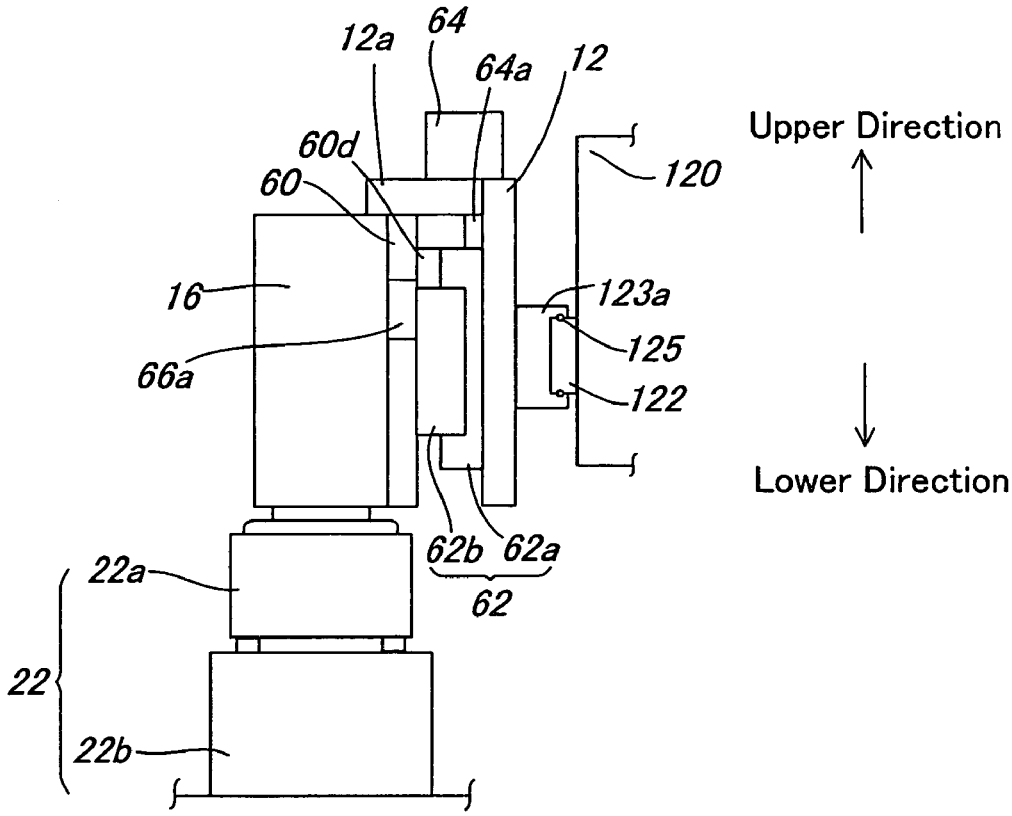
FIG. 4 is an explanatory view showing schematically the essential part of FIG. 1 wherein it is the explanatory view showing the essential part of FIG. 2 partially cutaway in the direction of the arrow C in FIG. 2 in a state in which a wall part being a stationary member is removed.

FIG. 1 is a schematic constitutional explanatory view showing an ink-jet printer according to an example in a manner of practice of the present invention, and FIGS. 2 to 4 are explanatory views each showing schematically an essential part of FIG. 1 wherein FIG. 2 is the explanatory view showing the essential part of FIG. 1 partially cutaway in the direction of the arrow A in FIG. 1, FIG. 3 is the explanatory view showing the essential part of FIG. 2 partially cutaway in the direction of the arrow B in FIG. 2, and FIG. 4 is the explanatory view showing the essential part of FIG. 2 partially cutaway in the direction of the arrow C in FIG. 2 in a state in which a wall part 68 is removed.

In an ink-jet printer 100 according to an example in a manner of practice of the present invention, a recording paper 200, as a medium, having a predetermined length in a main scanning direction being its breadth direction (the direction indicated by the arrow D in FIG. 1) is fed to a base member 114 which will be mentioned hereunder from a sheet feeder (not shown), and it is conveyed in a vertical scanning direction being perpendicular to the main scanning direction, namely in a longitudinal direction of the recording paper 200.

Such ink-jet printer 100 is composed of a stationary base member 114 supported by a pedestal member 112 and disposed extensively in the main scanning direction, side members 116L and 116R disposed perpendicularly to the base member 114 at the opposite ends thereof, a side unit 118 disposed on the side of the side member 116R, a central wall 120 connecting the two right and left side members 116L and 116R with each other, a guide rail 122 disposed on the wall of the central wall 120 extensively in the main scanning direction, a driving belt 124 disposed transferably in the main scanning direction along the wall of the central wall 120 (see FIG. 2), a carriage 12 mounted slidably on the guide rail 122, another carriage 14 disposed fixedly on the driving belt 124 and mounted slidably on the guide rail 122 at the same time, an ink head 16 disposed on the carriage 12 so as to be opposed to the recording paper 200 on the base member 114, a cutting head 20 disposed on the carriage 14 so as to be opposed to the recording paper 200 on the base member 114, and a maintenance unit 22 disposed in the side unit 118.

The whole operations of the ink-jet printer 100 are controlled by a microcomputer (not shown).

Furthermore, a reference numeral 126 designates an operation panel. The operation panel 126 is provided with a display for displaying an operation state, keys for specifying positions of the ink head 16 and the cutting head 20, respectively, keys for starting to produce an image or to cut out a recording paper on the basis of signals such as image data, and the other keys or the like.

Since a well-known technology is applied to the ink head 16, it is not shown and a detailed description therefor is omitted herein. However, the ink head 16 is composed of a plurality of ink head units each having the same constitution as that of the others wherein a plurality of ink-jet nozzles are disposed under the bottoms of the plurality of the ink head units as discharge ports for discharging inks to the recording paper 200, respectively.

To the plurality of respective ink head units of the ink head 16, inks having different colors from one another are supplied from a plurality of ink cartridges (not shown) containing liquid inks having different colors through ink tubes, respectively.

The ink head 16 composed of such plural ink head units as described above is fitted to the carriage 12 in such that the plurality of ink head units are aligned along the main scanning direction D, and the ink-jet nozzles of the ink head units may be opposed to the recording paper 200 on the base member 114.

The cutting head 20 is provided with a gripper 36 for holding a cutter 38 provided with a cutter blade 38*a* wherein the cutter 38 is held by the gripper 36 so as to be changeable a height position of the cutter blade 38*a*. The cutter blade 38*a* of the cutter 38 may be usual cutting knives of a swivel knife type, a rotary knife type and like type knives as a matter of course, and in addition, it may also be an ultrasonic disc cutter, a heat cutter by means of heat and the like cutters. A height position of the cutter blade 38*a* is changed at a predetermined timing determined by an instruction input by an operator through the operation panel 126, whereby the recording paper 200 is cut out based on image data while transferring the cutter blade 38*a* in the main scanning direction under a condition wherein the cutter blade 38*a* is allowed to abut upon the recording paper 200.

The cutting head 20 provided with the cutter 38 for cutting out the recording paper 200 is fixedly disposed on the carriage 14 in such that the cutter blade 38*a* is made to be abutable upon the recording paper 200 on the base member 114 in the case when a height position of the cutter blade 38*a* is changed.

The guide rail 122 is composed of a linear motion guide wherein four linear motion blocks 123*a*, 123*b*, 123*c*, and 123*d* being sliding blocks are disposed transferably along the guide rail 122.

Furthermore, a ball 125 is held rollably between the guide rail 122 and the linear motion block 123*a*, 123*b*, 123*c*, or 123*d*, and when the ball 125 rolls, the linear motion blocks 123*a*, 123*b*, 123*c*, and 123*d* are transferred smoothly on the guide rail 122.

The carriage 12 is fitted fixedly to the linear motion blocks 123*a* and 123*b* disposed transferably on the guide rail 122, while the carriage 14 is fitted fixedly to the linear motion blocks 123*c* and 123*d* disposed transferably on the guide rail 122, whereby the carriages 12 and 14 are mounted slidably on the guide rail 122.

The carriage 12 and the carriage 14 are sequentially disposed along the main scanning direction, and more specifically, the carriage 12 is positioned on the side of the side member 116R, while the carriage 14 is positioned adjacent to the left side of the carriage 12. Thus, the ink head 16 disposed on the carriage 12 and the cutting head 20 disposed on the carriage 14 are positioned in the order of the ink head 16 and the cutting head 20 on a line along the main scanning direction D starting from the side member 116R and extending to the side member 116L, i.e. from the right side direction to the left side direction in FIG. 1.

The ink head 16 is disposed on the carriage 12 through an ink head holder 60 for attaching stationarily the ink head 16 to hold it and a slide means 62 for transferring the ink head holder 60 in the upper and the lower directions being the direction intersecting with the main scanning direction at right angles.

The slide means 62 is composed of the guide rail 62*a* disposed extensively on a wall of the carriage 12 in the upper and the lower directions and constituted by the linear motion guide, and the linear motion block 62*b* being a sliding block disposed transferably along the guide rail 62*a*.

Furthermore, a ball 62*c* is held rollably between the guide rail 62*a* and the linear motion block 62*b*, and when the ball 62*c* rolls, the linear motion block 62*b* are transferred smoothly on the guide rail 62*a*.

The ink head holder 60 is attached fixedly to the linear motion block 62*b*, whereby the ink head holder 60 holding the ink head 16 is transferably disposed in a slidable manner in the upper and the lower directions along the guide rail 62*a*.

A motor 64 provided with a revolving shaft 64*a* the outer circumference of which is threaded externally is disposed on a left side end of the carriage 12, i.e. an end 12*a* of a side of the side member 116L. On one hand, an arm section 60*d* having a hole 60*c* around which is threaded internally to be screwed with the external thread of the revolving shaft 64*a* is disposed on a left side end of the ink head holder 60, i.e. an end 60*a* of a side of the side member 116L.

Moreover, a locking member 66 an extreme end 66*a* of which is bent downwards and formed in a crank shape is protrusively provided on a right side end of the ink head holder 60, i.e. an end 60*e* of a side of the side member 116R. The locking member 66 is adapted to be engaged with and detached from a hole 68*a* defined on a wall 68 being a stationary member which is integrally formed with the side member 116R of the ink-jet printer 100 and a central wall 120.

More specifically, as a result of movement of the ink head holder 60 in the upper and the lower directions and movement of the carriage 12 in right and left directions by means of the slide means 62, a bent portion of the extreme end 66*a* of the locking member 66 is locked with a fringe of the hole 68*a*, whereby the locking member 66 is in an engageable state with the hole 68*a*.

In the manner of practice, a locking mechanism for fixing lockably and detachably the carriage 12 provided with the ink head 16 to the wall 68 being a stationary region of the ink-jet printer 100 is constituted. The locking and detaching operation for the locking member 66 with the hole 68*a* is carried out, for example, by an operation key provided on the operation panel 126.

Furthermore, a magnet 70 is disposed on a left side wall 12L positioned on the side of the side member 116L in the end 12*a* of the carriage 12, while another magnet 72 attractable to the magnet 70 disposed on the left side wall 12 is disposed to a right side wall 20R positioned on the side of the side member 116R in the cutting head 20 fixed to the carriage 14.

The carriage 12 is suitably coupled to or detached from the carriage 14 by means of the magnet 70 disposed on the carriage 12 and the magnet 72 disposed on the cutting head 20 fixed to the carriage 14.

In these circumstances, it is arranged in such that an attraction force between the magnet 70 and the magnet 72 for coupling the carriage 12 to the carriage 14 is smaller than a holding power for maintaining an engaged state between the locking means 66 and the hole 68*a*.

In the manner of practice, a coupling mechanism for coupling the carriage 12 to the carriage 14 by means of the magnets 70 and 72 in a couplable and detachable fashion is constituted.

The carriage 14 is disposed fixedly on the driving belt 124, and when the driving belt 124 is traveled in the main scanning direction by means of a driving force of driving equipment (not shown) such as a motor, the carriage 14 is transferred in the main scanning direction along the guide rail 122 with the transfer of the driving belt 124.

In the case where the magnet 70 attracts the magnet 72 to each other thereby coupling the carriage 12 to the carriage 14, and an engagement of the locking member 66 with the hole 68*a* is disengaged, the carriage 12 is also transferred in the main scanning direction along the guide rail 122 with the above-described transfer of the carriage 14.

Since both of the carriage 12 and the carriage 14 are transferred in the main scanning direction as described above, the ink head 16 disposed on the carriage 12 and the cutting head 20 disposed on the carriage 14 are transferred in the main scanning direction with such transfer of the carriages 12 and 14. More specifically, the ink head 16 and the cutting head 20 are transferred in a going direction of the main scanning direction from the side of the side member 116R to the side of the side member 116L, and at the same time, they are transferred in a returning direction of the main scanning direction from the side of the side member 116L to the side of the side member 116R.

It is to be noted herein that a transfer area over which the carriages 12 and 14 are transferred in the going direction and the returning direction of the main scanning direction as described above, in other words, a transfer area of the ink head 16 and the cutting head 20 is wider than a print area corresponding to a predetermined length in a breadth direction along the main scanning direction of the recording paper 200 to be fed on the base member 114 from the sheet feeder (not shown).

As mentioned above, although both the carriage 12 and the carriage 14 are transferred in the main scanning direction, the carriage 12 is transferred in the returning direction at a predetermined timing in case of no printing operation thereby to be out of the print area, so that the carriage 12 stays at a standby position in the side unit 118. As a result, the ink head 16 disposed on the carriage 12 is positioned in the side unit 118 (see FIGS. 2 and 3).

A maintenance unit 22 for maintaining the ink head 16 is disposed in the side unit 118 in which the ink head is to be ready by means of the carriage 12 stayed in the standby position. The maintenance unit is provided with a cap device 22*a*, wiper means (not shown), and a suction device 22*b*.

The cap device 22*a* has a nozzle cap part, and the nozzle cap part covers an ink jet nozzle being a discharge port on the bottom of the ink head unit in the side unit 118. The cap device 22*a* protects an ink jet nozzle of an ink head unit in a standby state in the side unit 118 in case of no printing operation, whereby the cap device 22*a* can prevent from curing of an ink in an ink jet nozzle, or adhering of dusts to an ink jet nozzle.

The wiper means is provided with a blade, and the blade abuts upon the bottom of an ink head unit in the side unit 118. An ink remained on or a fouling such as foreign matters adhered to the bottom of the ink head unit which is in a standby state in the side unit 118 can be removed by the wiper means in case of no printing operation.

The suction device 22*b* is provided with a suction pump, a motor for driving the suction pump and the like components, and the suction device 22*b* sucks an ink from an ink jet nozzle of an ink head unit which is in a standby state in the side unit 118 in case of no printing operation, whereby the ink remained in the ink jet nozzle can be removed.

The maintenance unit 22 provided with the cap device 22*a*, the wiper means and the suction device 22*b* is adapted to be positioned in the side unit 118 in such that the maintenance unit 22 is located in a lower side of the ink head 16 disposed on the carriage 12, i.e. a discharge side of an ink disposed on an ink jet nozzle in the ink head unit of the ink head 16 in a standby position in the side unit 118 wherein the carriage 12 is transferred in the returning direction in the main scanning direction to come to rest.

In the constitution as described above, operations for forming a desired picture image to print out the picture image on a recording paper 200 or cutting out such picture image to separate an outline of the picture image from the recording paper 200 by means of the above-described ink-jet printer 100 will be described.

In the manner of practice, an initial condition means such a state that the carriage 12 comes to rest in a standby position, and the ink head 16 positions in the side unit 118 (a state shown in FIG. 2). In the initial condition, the magnet 70 attracts the magnet 72 to each other, the carriage 12 couples to the carriage 14 by means of a coupling means, besides, the locking member 66 engages with the hole 68*a*, and the carriage 12 is engaged with the wall 68 being a stationary region of the ink-jet printer 100 by means of a locking means.

In case of printing, first, the motor 64 is driven based on control of a microcomputer in accordance with an instruction input through the operation panel 126 to transmit a torque of the revolving shaft 64*a* of the motor 64 to the arm section 60*d* having the hole 60*c* threaded internally screwed with the revolving shaft 64*a* threaded externally, whereby the ink head holder 60 associated with the arm section 60*d* is transferred upwards.

Figure 5:
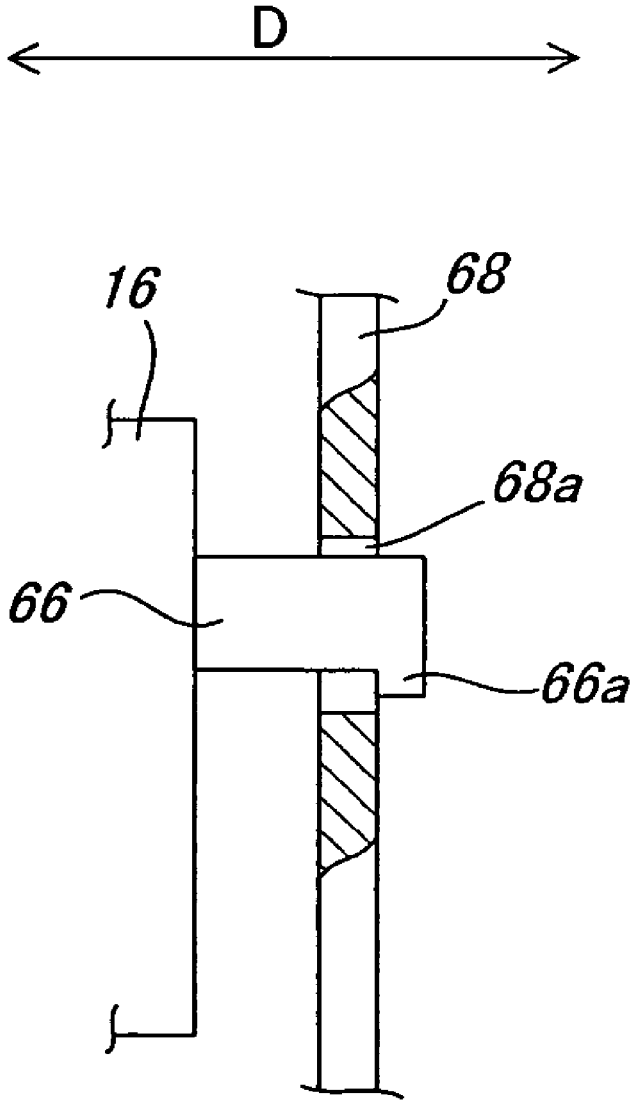
FIG. 5 is an explanatory view showing operations of an ink-jet printer according to an example in a manner of practice of the present invention.

More specifically, since the ink head holder 60 associated with the arm section 60*d* is disposed transferably in the upper and the lower directions with respect to the carriage 12 by means of the slide means 62, the linear motion block 62*b* attached to the ink head holder 60 is slid along the guide rail 62*a* in response to a rotation direction of the revolving shaft 64*a* transmitted to the arm section 60*d*, so that the ink head holder 60 can be transferred upwards (see FIG. 5).

Figure 6:
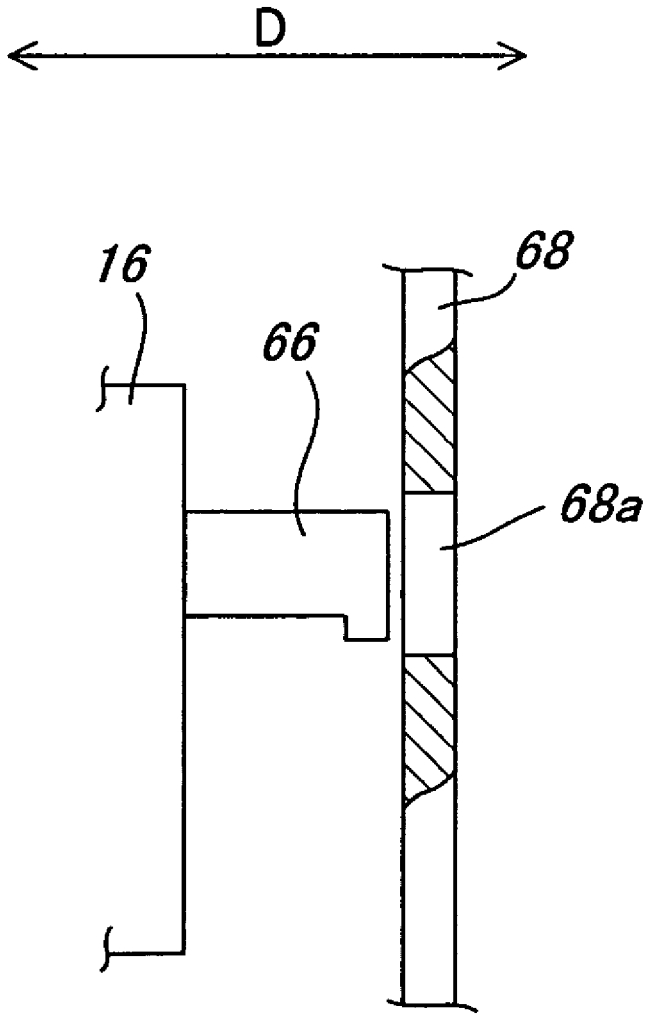
FIG. 6 is an explanatory view showing operations of an ink-jet printer according to an example in a manner of practice of the present invention.

Then, when the carriage 12 and the carriage 14 coupled by the coupling means are transferred associatedly in the left direction in the main scanning direction, the locking member 66 is disengaged from the hole 68*a* to release fixation of the carriage 12 to the wall 68 being a stationary member of the carriage 12 (see FIG. 6).

Thereafter, when the carriage 14 is transferred with transfer of the driving belt 124, the carriage 14 associated with the carriage 12 by means of a coupling means is also transferred with transfer of the carriage 12. Namely, the carriage 12 and the carriage 14 are transferred while maintaining their associated coupling state, so that printing is carried out on a recording paper 200 by means of the ink head 16.

On one hand, in case of cutting out an outline of a picture image printed, the carriage 12 associated with the carriage 14 is transferred in the right direction in the main scanning direction based on control of the microcomputer in accordance with an instruction input through the operation panel 126, whereby the locking member is passed through the hole 68*a* (see FIG. 5).

Then, the motor 64 is driven to transmit a torque of the revolving shaft 64*a* of the motor 64 to the arm section 60*d* having the hole 60*c* threaded internally screwed with the revolving shaft 64*a* threaded externally, whereby the ink head holder 60 associated with the arm section 60*d* is transferred downwards and returned to the initial condition.

More specifically, since the ink head holder 60 associated with the arm section 60*d* is disposed transferably in the upper and the lower directions with respect to the carriage 12 by means of the slide means 62, the linear motion block 62*b* attached to the ink head holder 60 is slid along the guide rail 62*a* in response to a rotation direction of the revolving shaft 64*a* transmitted to the arm section 60*d*, so that the ink head holder 60 can be transferred downwards (see FIG. 2).

Thereafter, the locking member 66 is engaged with the fringe of the hole 68*a*, whereby the carriage 12 is fixed to the wall 68 being a stationary member, the locking member 66 causing the carriage 14 to transfer with transfer of the driving belt 124 in the going direction in the main scanning direction, and it is arranged in such that an attraction force of the magnet 70 and the magnet 72 by which the carriage 12 is coupled to the carriage 14 is smaller than a holding force in an engaged state of the locking member 66 in the carriage 12 with the hole 68*a*. Accordingly, the magnet 70 is drawn away from the magnet 72, whereby the carriage 12 is separated from the carriage 14.

As a result of control by the microcomputer, a height position of the cutter blade 38*a* of the cutter 38 in the cutting head 20 is changed, and the carriage 14 is transferred in the going and returning directions in the main scanning direction with transfer of the driving belt 124 in a state wherein the cutter blade 38*a* of the cutter 38 abuts upon the recording paper 200 on the base member 114, whereby the recording paper 200 can be cut off by the cutter blade 38*a* of the cutter 38 in the cutting head 20.

It is to be noted that the above-described manner of practice may be modified as described in the following paragraphs (1) through (4).

(1) In the above-described manner of practice, although the slide means 62 allows the ink head holder 60 to be transferred in the upper direction and the lower directions intersecting with the main scanning direction at right angles, the transferring direction is not restricted to that wherein the slide means 62 allows the ink head holder 60 to be transferred in the upper direction and the lower directions intersecting with the main scanning direction at right angles as a matter of course, but angles and directions intersecting with the main scanning direction may be suitably changed in response to designs of the components in an ink-jet printer.

(2) In the above-described manner of practice, although the coupling means for coupling separably the carriage 12 to the carriage 14 is composed of the magnet 70 and 72, the invention is not limited thereto as a matter of course, but specific structure of such coupling means, the total number thereof, layout positions therefor may be suitably modified. For example, the coupling means may be composed of a magnet and an iron plate.

(3) In the above-described manner of practice, although it is arranged in such that the ink head 16 and the cutting head 20 are transferred in the main scanning direction, while the recording paper is transferred in the vertical scanning direction, the invention is not limited thereto as a matter of course, but, for example, such transferring mechanism may be constituted in that of a so-called flat-bed type wherein the recording paper 200 is not transferred, but the ink head 16 and the cutting head 20 are transferred in the main scanning direction and the vertical scanning direction.

(4) The above-described manner of practice as well as the modifications in the above-described paragraphs (1) through (3) may be suitably combined with each other.

It will be appreciated by those of ordinary skill in the art that the present invention can be embodied in other specific forms without departing from the spirit or essential characteristics thereof.

The presently disclosed embodiments are therefore considered in all respects to be illustrative and not restrictive. The scope of the invention is indicated by the appended claims rather than the foregoing description, and all changes that come within the meaning and range of equivalents thereof are intended to be embraced therein.

The entire disclosure of Japanese Patent Application No. 2005-347527 filed on Dec. 1, 2005 including specification, claims, drawings and summary are incorporated herein by reference in its entirety.

What is claimed is:

1. An ink-jet printer capable of discharging an ink on a medium and cutting out the medium, comprising:

a first carriage supported relatively transferable in a predetermined direction with respect to the medium;

a second carriage supported relatively transferable in the predetermined direction with respect to the medium and juxtaposed so as to be positioned on a side in the predetermined direction of the first carriage;

a slide means disposed on the first carriage to be transferable in a direction intersecting with the predetermined direction;

an ink head disposed fixedly on the slide means and capable of discharging an ink on the medium;

a cutting head disposed fixedly on the second carriage and capable of cutting out the medium;

a locking member transferred with transfer of the first carriage towards the predetermined direction and transfer of the slide means towards direction intersecting with the predetermined direction to lock engageably and detachably with a stationary region; and a coupling means for coupling separably the first carriage to the second carriage.

2. An ink-jet printer capable of discharging an ink on a medium and cutting out the medium, comprising:

a first carriage supported relatively transferable in a predetermined direction with respect to the medium;

a second carriage supported relatively transferable in the predetermined direction with respect to the medium and juxtaposed so as to be positioned on a side in the predetermined direction of the first carriage;

a slide means disposed on the first carriage to be transferable in a direction intersecting with the predetermined direction;

an ink head disposed fixedly on the slide means and capable of discharging an ink on the medium;

a cutting head disposed fixedly on the second carriage and capable of cutting out the medium;

a locking member transferred with transfer of the first carriage towards the predetermined direction and transfer of the slide means towards a direction intersecting with the predetermined direction to lock engageably and detachably with a stationary region; and a coupling means for coupling separably the first carriage to the second carriage;

the locking member being allowed to disengage from the stationary region, whereby the first carriage is detached from the stationary region and the first carriage is coupled to the second carriage by the coupling means, so that the ink head disposed on the first carriage is transferred associatedly with the cutting head disposed on the second carriage in case of printing on the medium; while the locking member being allowed to engage with the stationary region, whereby the first carriage is engaged with the stationary region and the first carriage is separated from the second carriage by the coupling means, so that only the cutting head disposed on the second carriage is transferred in case of cutting the medium.

3. The ink-jet printer as claimed in any one of claims 1 and 2, wherein the slide means is provided with:

a slide block disposed transferably along the guide rail disposed on a wall surface of the first carriage and extended in a direction intersecting with the predetermined direction.

4. The ink-jet printer as claimed in claim 3, wherein:

the ink head is disposed fixedly to the slide block.

5. The ink-jet printer as claimed in claim 4, comprising further: a driving means for driving the slide block.

6. The ink-jet printer as claimed in claims 3, comprising further:

a driving means for driving the slide block.

7. The ink-jet printer as claimed in any one of claims 1 and 2, wherein:

the direction intersecting with the predetermined direction is a direction intersecting with the predetermined direction at right angles.

8. The ink-jet printer as claimed in any one of claims 1 and 2, wherein:

the locking member is formed extensively in a direction of the stationary region and has a bent extreme end; and the stationary region has a hole for engaging with the extreme end of the locking member.

9. The ink-jet printer as claimed in any one of claims 1 and 2, wherein:

the coupling means is composed of magnets.

10. The ink-jet printer as claimed in claim 9, wherein:

an attraction force of the magnets is smaller than an engagement force derived from an engagement of the locking member and the stationary region.

* * * * *